US009457885B2

(12) United States Patent
Guglielmo et al.

(10) Patent No.: US 9,457,885 B2
(45) **Date of Patent: *Oct. 4, 2016**

(54) DUAL RUDDER WATERCRAFT STEERING CONTROL SYSTEM FOR ENHANCED MANEUVERABILITY

(71) Applicant: Enovation Controls, LLC, Tulsa, OK (US)

(72) Inventors: Kennon Guglielmo, San Antonio, TX (US); Christopher Cole, Spring Branch, TX (US)

(73) Assignee: Enovation Controls, LLC, Tulsa, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/562,926

(22) Filed: Dec. 8, 2014

(65) Prior Publication Data

US 2015/0090170 A1 Apr. 2, 2015

Related U.S. Application Data

(63) Continuation of application No. 13/290,943, filed on Nov. 7, 2011, now Pat. No. 8,943,988.

(60) Provisional application No. 61/410,811, filed on Nov. 5, 2010.

(51) Int. Cl.

| | |
|---|---|
| ***B63H 25/36*** | (2006.01) |
| ***B63H 25/38*** | (2006.01) |
| ***B63H 1/04*** | (2006.01) |
| ***B63H 5/07*** | (2006.01) |
| ***B63H 21/21*** | (2006.01) |
| ***B63H 21/00*** | (2006.01) |
| ***B63H 23/34*** | (2006.01) |
| ***B63H 25/02*** | (2006.01) |
| *B63H 25/06* | (2006.01) |

(52) U.S. Cl.

CPC ..... *B63H 25/38* (2013.01); *B63H 1/04* (2013.01); *B63H 5/07* (2013.01); *B63H 21/21* (2013.01); *B63H 21/24* (2013.01); *B63H 23/34* (2013.01); *B63H 25/02* (2013.01); *B63H 25/36* (2013.01); *B63H 2025/063* (2013.01); *B63H 2025/066* (2013.01)

(58) Field of Classification Search

CPC ..... B63H 2025/066

See application file for complete search history.

(56) References Cited

U.S. PATENT DOCUMENTS 2,851,001 A * 9/1958 Scott ..... B63H 25/38 114/163

8,943,988 B1 * 2/2015 Guglielmo ..... B63H 25/38 114/144 R

*Primary Examiner* — Edwin Swinehart

(74) *Attorney, Agent, or Firm* — William H. Quirk; Jesse L. Frizzell; Rosenthal Pauerstein Sandoloski Agather LLP

(57) ABSTRACT

A steering control system for ski boat with an inboard motor and a single, non-steerable propeller. The control system augments the traditional aft rudder with a forward rudder (located immediately in front of the propeller), and controls one or both rudders to improve steering when backing and in low forward speed conditions. The control system may control only the forward rudder, while the pre-existing controls operate the aft rudder, or optionally controls both rudders. The rudder angle control algorithm calculates proportional rudder angles based on helm and throttle settings, or optimal rudder angles based on more sensed conditions including the operator's helm and throttle controls, the ski boat's direction and speed, propeller RPM and thrust direction, and each rudder's angle. An electronic controller sends control signals to the rudders to achieve the optimal rudder angles.

17 Claims, 6 Drawing Sheets

| V | Φ | α |
|---|---|---|
| $V \geq W$ | all | 0° |
| $0 < V < W$ | $\Phi > 10°$ | max |
| | $\Phi < -10°$ | max |
| $-W < V < 0$ | all | ± max |
| $V \leq -W/2$ | all | Kβ |

W = Forward, wake-generating speed

Φ = Helm's target turn angle (positive being a right turn and negative being a left turn)

FIG. 6

| | | V (kts) | | | | |
|---|---|---|---|---|---|---|
| | | 1 | 2 | 3 | 4 | 5 |
| Max | Helm | Fwd α | Fwd α | Fwd α | Fwd α | Fwd α |
| 35 | 2 | 3.00 | 2.25 | 2.11 | 2.06 | 2.04 |
| | 4 | 8.00 | 5.00 | 4.44 | 4.25 | 4.16 |
| | 6 | 15.00 | 8.25 | 7.00 | 6.56 | 6.36 |
| | 8 | 24.00 | 12.00 | 9.78 | 9.00 | 8.64 |
| | 10 | 35.00 | 16.25 | 12.78 | 11.56 | 11.00 |
| | 12 | 35.00 | 21.00 | 16.00 | 14.25 | 13.44 |
| | 14 | 35.00 | 26.25 | 19.44 | 17.06 | 15.96 |
| | 16 | 35.00 | 32.00 | 23.11 | 20.00 | 18.56 |
| | 18 | 35.00 | 35.00 | 27.00 | 23.06 | 21.24 |
| | 20 | 35.00 | 35.00 | 31.11 | 26.25 | 24.00 |
| | 22 | 35.00 | 35.00 | 35.00 | 29.56 | 26.84 |
| | 24 | 35.00 | 35.00 | 35.00 | 33.00 | 29.76 |
| | 26 | 35.00 | 35.00 | 35.00 | 35.00 | 32.76 |
| | 28 | 35.00 | 35.00 | 35.00 | 35.00 | 35.00 |
| | 30 | 35.00 | 35.00 | 35.00 | 35.00 | 35.00 |
| | 32 | 35.00 | 35.00 | 35.00 | 35.00 | 35.00 |
| | 34 | 35.00 | 35.00 | 35.00 | 35.00 | 35.00 |
| | 35 | 35.00 | 35.00 | 35.00 | 35.00 | 35.00 |

$\alpha = \phi + [\phi / (2*V)]^2$

Helm command = $\phi$

Desired forward rudder angle (absolute value) = $\alpha$

Actual Hull speed = V

DUAL RUDDER WATERCRAFT STEERING CONTROL SYSTEM FOR ENHANCED MANEUVERABILITY

CLAIM OF PRIORITY TO PRIOR APPLICATION

This application claims the benefit of the filing date of U.S. Non-Provisional application Ser. No. 13/290,943, filed on Nov. 7, 2011, as well as U.S. Provisional Application Ser. No. 61/410,811, both entitle entitled "Dual Rudder Watercraft Steering Control System for Enhanced Maneuverability", the entire disclosures of which are hereby incorporated by reference into the present disclosure.

FIELD OF THE INVENTION

The present invention relates to the field of sporting competition and recreational boating and, more particularly, to steering control systems and methods for sport ski boats, most typically for rudder steering controls for sport ski boats having one or more inboard motors and dependent propellers.

BACKGROUND

Significant industries revolve around the manufacture, sale and use of ski boats. For terminology purposes of this application, we will use the term "ski boat" (occasionally "sport ski boat") to refer to any watercraft that falls within the common understanding of a ski boat, a sport ski boat (also known as "sport/ski" or "sport-ski" boats), a tow boat, or any comparable watercraft such as are designed and used for towing recreational or competition water skiers, barefooters, kites, wakeboarders, or tubers, irrespective of whether a particular boat is ever actually used for such purposes, and even though such boats may instead be used for other purposes such as fishing, cruising, patrolling, transport or the like.

Most inboard ski boats have non-steerable propellers that use a single rudder behind each propeller to control steering. Ski boats having a solitary non-steerable propeller, including fixed pitch and controllable pitch types, have the longitudinal centerline of their propeller shaft fixed in alignment with the longitudinal centerline of the watercraft. In a typical watercraft of this type, the propeller shaft is attached to the inboard motor; the shaft extends through the hull, is braced by a strut on the underside of the hull, and terminates at the propeller. Other inboard motor watercraft include more complicated configurations where a transmission, gearbox or other linkage connects the engine's drive shaft to the propeller shaft, such as with a "V-drive" propulsion system. For purposes of this patent application, embodiments tend to be described in terms of the simpler embodiments, such as where the propeller shaft is the same as the engine shaft, but description with reference to a single or simple structure should be understood to encompass more combined or complicated structures that can be substituted for the single or simple structure.

Regardless of such particulars, most inboard motor watercraft have a rudder positioned aft of each propeller, along the extended centerline of the propeller shaft. The aft rudders are typically controlled mechanically with a helm, like a steering wheel, that is mounted on the deck of the watercraft. Control linkage between the helm and rudders is often achieved with control cables or other mechanical linkage, although "drive by wire" electronic controls are also well known as substitutes for mechanical linkages, particularly on larger watercraft.

At medium to high hull speeds, water flow past the aft rudder(s) is sufficient to allow for responsive handling by the operator. However, at slow hull speeds and at low propeller thrust, there is little water flow past the aft rudder, and the steering system is less effective. With slow water speed past the rudder, such as is typically encountered when docking a watercraft, laminar flow on both surfaces of the rudder is tentative at best, and resulting steering forces (i.e., yaw moments of inertia) are very limited, as is the operator's ability to steer the watercraft with the rudder.

Comparable or worse challenges also arise when a watercraft is moving astern. While the aft rudder is effectively upstream of the propeller when moving astern, the water flow across the aft rudder can be even more reduced because the propeller wash is directed away from the aft rudder. As a result, the aft rudder provides reduced directional control. This reduced control makes it more difficult to successfully maneuver the watercraft, especially in a crowded area or near a dock or loading ramp.

Many other problems, obstacles, limitations and challenges of the prior art will be evident to those skilled in the art.

BRIEF SUMMARY OF THE INVENTION

Aspects of the present invention address such problems, obstacles, limitations and challenges by providing ski boats with an improved steering system that allows for increased steering control when traveling at slow speeds and/or when traveling astern. More particularly, certain aspects of the present invention achieve such increased steering control by increasing the effective turning surface in such conditions. Other aspects of the invention relate to the use of rudders both fore and aft of the propellers. Preferably in a "steer by wire" system, other aspects of the invention provide systems and methods for controlling the steering of watercraft in a manner that is directly or indirectly dependent on water speed flowing past the rudders. The invention may be retrofitted to many types of watercraft including those with fixed or controllable pitch propellers, traditional or V-drive propulsions systems, and other configurations.

To improve steering when making way astern or slow ahead, preferred embodiments of the invention augment the traditional aft rudder (located behind the propeller) with a forward rudder (located immediately in front of the propeller). The axis of rotation for each such rudder is along (i.e., generally intersects) the extended longitudinal centerline of the propeller shaft. Both fore and aft rudders are installed with their wide ends (i.e., the end closest to its axis of rotation) nearest to the propeller and their narrow ends leading ahead and trailing aft, respectively. When making way ahead, water flows across the aft rudder from its wide leading edge to its trailing thinner edge. Conversely, the forward rudder is installed with the narrow end of the rudder nearest the bow and the wide end of the rudder near the propeller. When making way ahead, the traditional trailing edge of the forward rudder actually acts as a leading edge, encountering the waterflow before the traditional leading edge of the forward rudder. However, when making way astern, the forward rudder presents its traditional leading edge to the flow and thus generates greater steering forces.

The optimal clearance between the aft rudder and the propeller is a function of the size and shape of the watercraft, the size of the propeller, and other hydrodynamic factors known to those of skill in the art. Similarly, the optimal clearance between the forward rudder and the maximum forward extension of the propeller blades is a function of the same factors, although the location and dimensions of the propeller strut must also be considered.

In at least one embodiment, aspects of the invention involve controlling the forward rudder's angle using an electronic controller. The electronic controller receives inputs including the operator's steering command, throttle setting, the vessel's direction and speed through the water, propeller revolutions per minute (RPM) and thrust, and each rudder's angle. Aspects of such embodiments apply logic and algorithms of the invention to generate forward rudder angle commands that allow adaptation of dual rudder control relative to hull speed, which commands are then sent to the corresponding rudder actuators and controllers.

In some embodiments of the invention, the electronic controllers control the movement of both the fore and aft rudder, while other embodiments focus on electronic control of a forward rudder dependant in part on the conventional control of rear rudders. Such electronic controllers can receive all of the previously listed inputs as well as other information and generates forward and aft rudder angle commands based thereon, which it sends to the respective rudder controllers.

The disclosures of this patent application, including the descriptions, drawings, and claims, describe one or more embodiments of the invention in more detail. Many other features, objects, and advantages of the invention will be apparent from these disclosures to one of ordinary skill in the art, especially when considered in light of a more exhaustive understanding of the numerous difficulties and challenges faced by the art. While there are many alternative variations, modifications and substitutions within the scope of the invention, one of ordinary skill in the art should consider the scope of the invention from a review of any claims that may be appended to applications and patents based hereon (including any amendments made to those claims in the course of prosecuting this and related applications).

BRIEF DESCRIPTION OF THE DRAWINGS

FIG. 6 is a chart depicting various preferred control strategies for algorithm 70 of the electronic controller 113, wherein the various operating ranges of the forward rudder 50 are expressed as a function based on the watercraft's velocity, 'V', in relation to the helm angle, 'ϕ', yielding the preferred forward rudder angle, α.

DETAILED DESCRIPTION OF PREFERRED EMBODIMENTS

Figure 1:
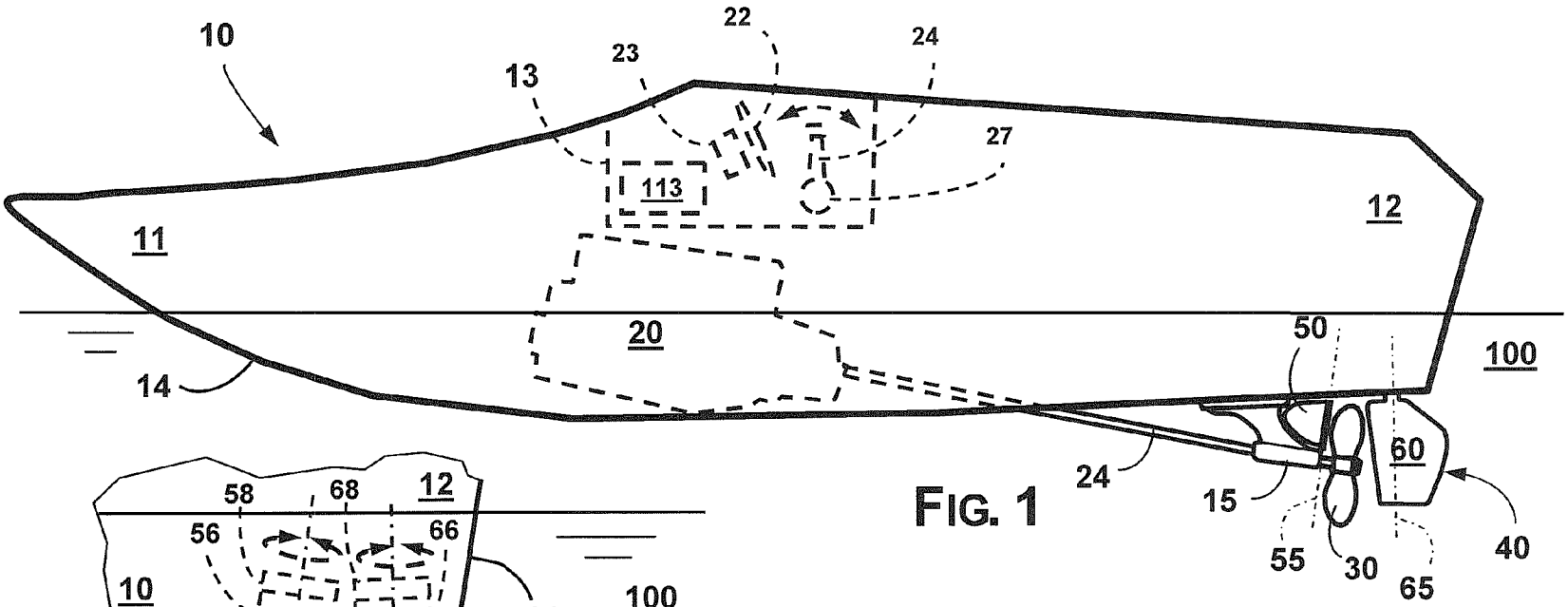
FIG. 1 is a simplified elevation view of a watercraft 10 that embodies and incorporates and uses embodiments of the invention, with watercraft 10 shown operatively floating in a body of water 100.

With reference to FIG. 1, most preferred embodiments of the present invention include a dual rudder steering control system for a watercraft 10, which is preferably a ski boat with an inboard motor 20 and a single, non-steerable propeller 30. The dual rudder steering control system can be designed into a new watercraft 10, or may be retrofitted to an existing watercraft where it interacts with, augments, and in some embodiments, replaces portions of the watercraft's pre-existing steering control systems.

Please understand that the figures and descriptions in this application depict specific examples to teach watercraft designers and others skilled in the art how to make and use one or more expected best modes of the invention, recognizing that such designers are very familiar with existing ways of accomplishing incidental aspects of watercraft embodiment. To concisely teach inventive principles, some conventional aspects of the invention have been simplified or omitted. From these specific examples, those skilled in the art will have great understanding despite any inadvertent errors and will be able to appreciate many different configurations, combinations, sub-combinations, and variations that are not specifically disclosed but would still fall within the scope of the invention. However, the invention is not limited to the specific illustrative examples described herein, but instead, the invention is limited only by the current, amended, or added claims and their equivalents.

Embodiments of the invention use a number of presently available components including controls, actuators, sensors, communication means, and computers. For example, the invention can interface with helms of various types including mechanical, electromechanical, electric, hydraulic, electronic and other steering control types. Example helms include a wheel, lever, joystick, trackball, mouse, touchpad, voice activated controls, and the like or any others that are now or in the future known. Likewise, the invention can interface with virtually any throttle control type including mechanical, electric, electronic, and more. To implement steering commands, the invention may interact with the watercraft's pre-existing rudder control mechanisms (which may be of various sorts), and may add other presently available means such as mechanical levers, pulleys, cables, wheels; electric motors; electromechanical devices; hydraulic actuators; pneumatic actuators; or other means to set or change the rudder angle.

Preferred embodiments also use presently available sensors to sense and transmit conditions (sensed conditions) including: throttle control position and movement; helm direction, amplitude, and movement; hull speed and direction; propeller RPM, direction of rotation, and pitch setting; and rudder angle and rudder angle position. The corresponding sensors (27, 23, 414, 411, 58 and 68) are depicted herein more schematically, with minimal specificity. It should be understood, though, that such sensors come in many forms and may include accelerometers, angle sensors, angle position sensors, encoders, potent meters, strain gauges, electronic devices, and any other means known to or later discovered by those of skill in the art to detect and report conditions of the corresponding devices and operating and environmental conditions. It should also be understood that many such sensors may be integral with accompanying actuators or other components even though they may be shown discreetly. Also understand that equivalent sensors may approximate sensing of the intended object by approximating from other indicators or other algorithms.

Mechanical Structures

Figure 2:
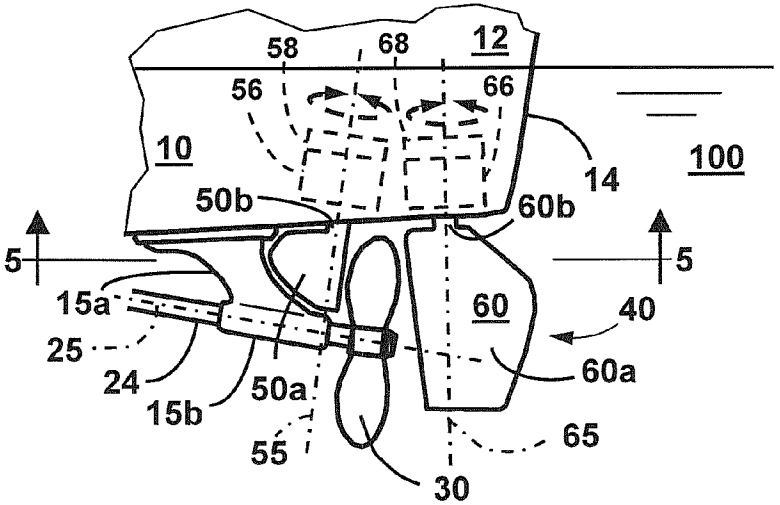
FIG. 2 is a detail view of the rudder assembly 40 and closely related components of FIG. 1.
Figure 3:
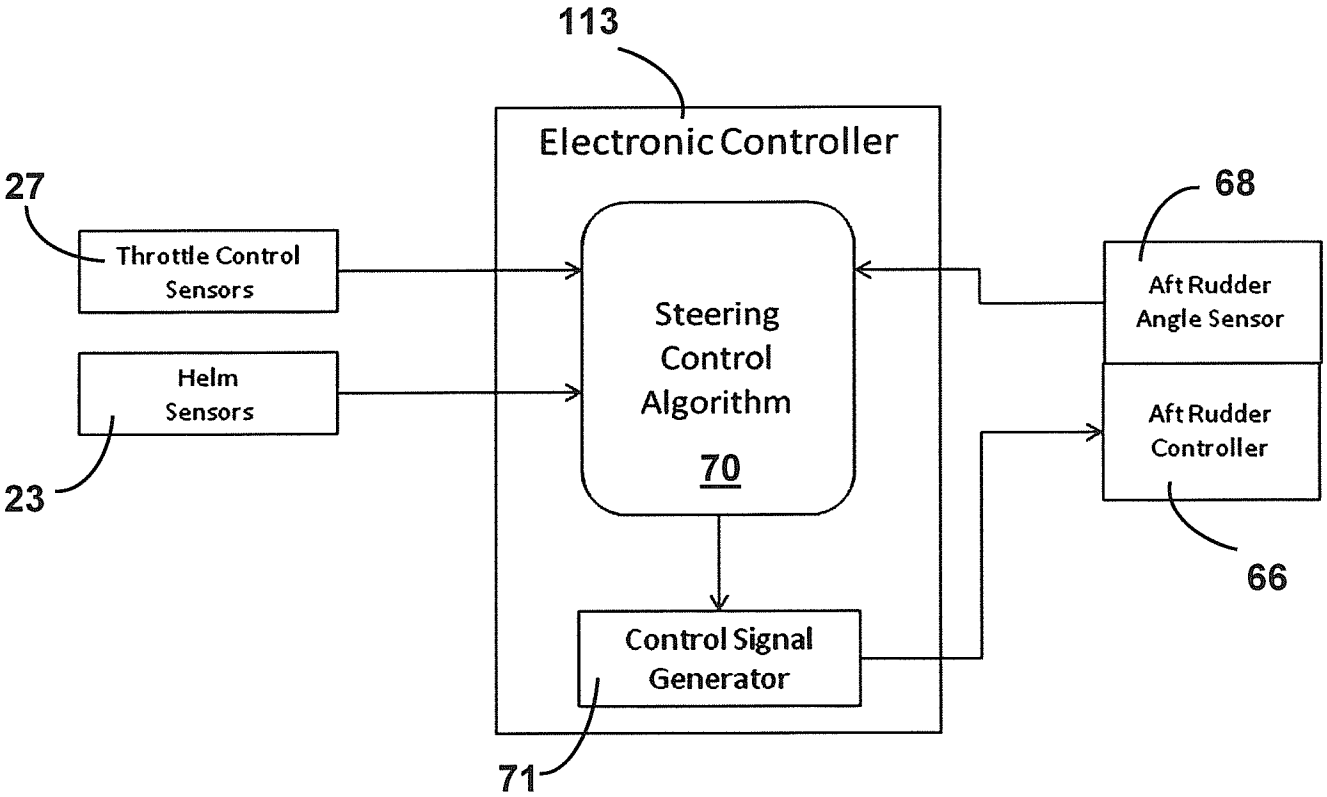
FIG. 3 is a diagram conceptually illustrating inputs to, and outputs from, an electronic controller 113 of preferred embodiments in an example where the electronic controller 113 controls only the forward rudder 50 of FIG. 2 and other embodiments.
Figure 4:
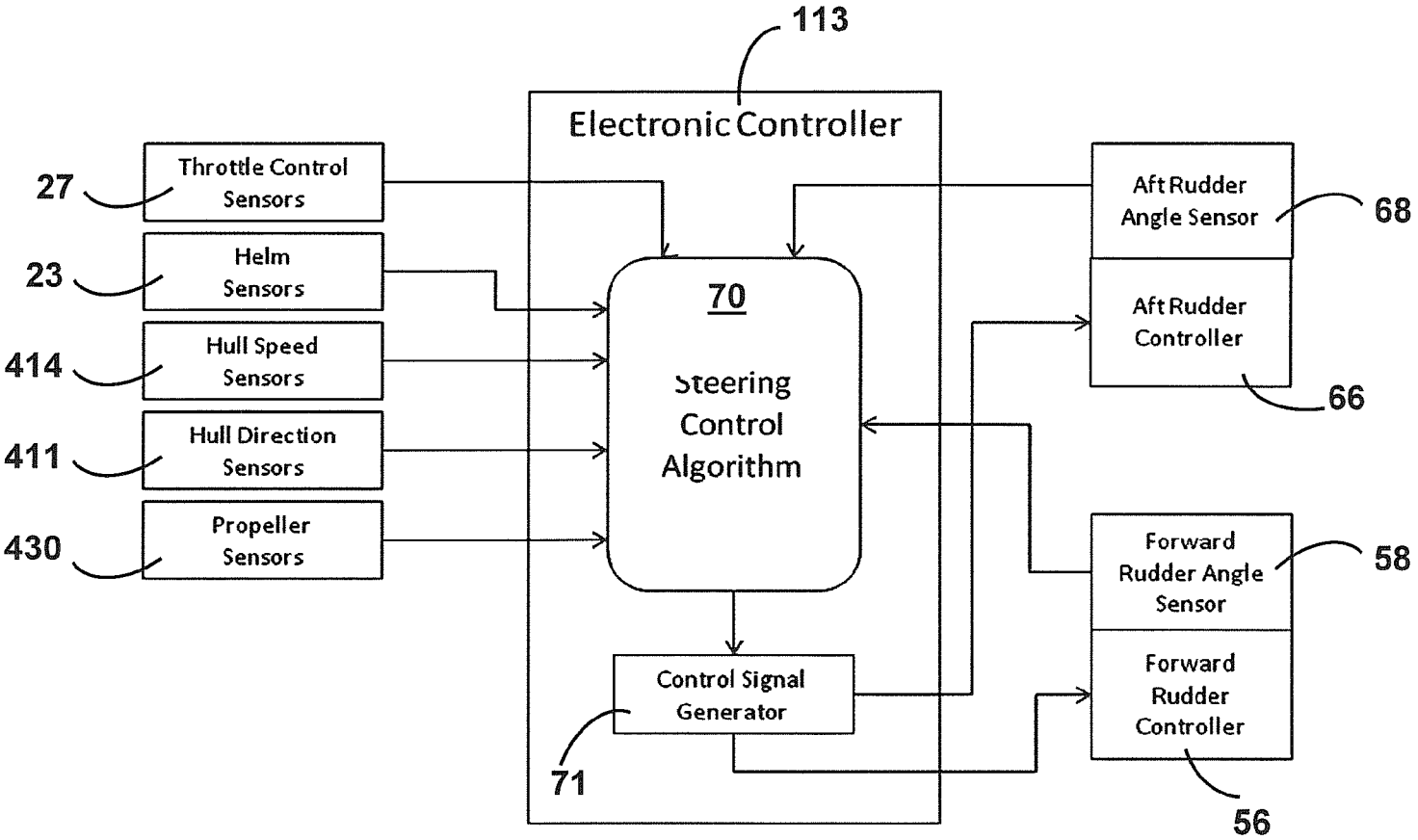
FIG. 4 is a diagram conceptually illustrating inputs to, and outputs from, the electronic controller 113 in an example where the electronic controller controls both the forward rudder 50 and the aft rudder 60 of FIG. 2 and other embodiments.

With reference to FIGS. 1 and 2, the rudder assembly 40 of watercraft 10 essentially provides a forward rudder 50 in close proximity to the forward edge of the operative space of propeller 30 beneath hull 14. Coupled with a conventional aft rudder 60, the combination provides a dual rudder system 40 capable of achieving many of the advantages of the present invention. As is conventional, aft rudder 60 is controlled by an actuator 66 which may be any of the conventional rudder actuators for use in conjunction with an electronic controller 113. In operation, controller 66 may be an electric motor or other hydraulic, electro-hydraulic, or other conventional means of controlling operative movement of rudder 60 in response to commands from the control signal generator 71 of electronic controller 113.

Rudder 60 has an operating body portion 60*a* which generally depends behind the generally vertical pivot axis 65 of aft rudder 60. A rudder controller 66 is contained in the stern 12 of boat 10, together with a rudder angle sensor 68. Rudder 60 is connected to rudder controller 66 by a rotatable stem 60*b* of rudder 60, to achieve pivotal connection with watercraft 10. Likewise, but in reverse, forward rudder 50 also includes a principal operating surface 50*a* which is connected to a rudder position controller 56 contained within the hull 14 of watercraft 10. Again, as with typical marine rudders, forward rudder 50 is connected to its controller 56 by a stem (or shaft) 50*b* which is concentric with the pivot access 55 of fore rudder 50. As can be seen in FIG. 2, in FIG. 2 (as well as in FIG. 5) the pivot access 55 of fore rudder 50 intersects and is generally perpendicular with the access 25 of propeller shaft 24, and the rearward edge (i.e., the edge closest to the stern 12) of fore rudder 50 is positioned in close proximity with the operating path of propeller 30 with the forward most edge (i.e., the edge closest to the bow) of propeller 30. Such close proximity is preferably less than an inch in separation, although this may vary intolerances and the like and relative sizes of the fore rudder 50 and propeller 30.

To achieve operative effect and movement left and right of the centerline 10*a* of boat 10, fore rudder 50 is positioned forward of propeller 30. The body 50*a* of fore rudder 50 is sized and shaped to fit with adequate clearance as shown in FIG. 2. Such fit allows rudder 50 to pivot up to 35°, either left or right, from the centerline 10*a* of boat 10 without interference. Rudder 50 is sized and shaped to achieve such clearance between the bottom of hull 14 and the curve the rearward edge of propeller shaft support 15*a*. Hence, the pivot axes 55 and 65 of rudders 50 and 60 (respectively) are substantially parallel generally coplaner with the axis 25 of propeller shaft 24, as well as with the central line 10*a* of watercraft 10.

Electronic Controllers

The electronic controller 113 uses one or more presently available computing devices which contain a processor, memory, one or more input means, and one or more output means. The electronic controller 113 preferably stores part, or all, of the rudder angle control algorithm 70. The electronic controller 113 receives information on the sensed conditions and calculates the desired rudder angle(s) according to the algorithm 70. The electronic controller 113 then uses its control signal generator 71 to communicate a corresponding angle command to the appropriate rudder controller (56, 66). The rudder controller (56, 66) uses commercially available or predictable equipment that receives the rudder angle control signal from generator 71 (either by wire or wirelessly) and sets or changes the rudder angle ($\alpha$, $\beta$) to the commanded angle.

Rudder Angle Control Algorithms

A rudder angle control algorithm 70 is preferably implemented in the electronic controller 113. The algorithm 70 may include any common or advanced control loop transfer function including, but not limited to, series, parallel, ideal, interacting, noninteracting, analog, classical, and Laplace types.

The rudder angle control algorithm 70 calculates desired rudder angles $\alpha$ and $\beta$ based on input information from an appropriate one or more of the sensors (23, 27, 58, 68, 411 and 414) that are available. The algorithm 70 receives input information from the watercraft's systems and controls that are equipped with such sensors. As used herein, the term sensor is not limited to a single device detecting and reporting a single condition. A sensor may be one or more devices detecting and reporting one or more conditions. The helm sensor 23 detects the helm setting, meaning the direction and amplitude of the command the operator is setting such as left ten degrees rudder, right twenty degrees rudder, etc. The throttle sensor 27 detects the amplitude and direction the operator has selected for the propulsion system such as ahead 40% thrust, astern 20% thrust, or neutral (no propulsive thrust). In some embodiments, the helm and throttle sensors 23, 27 may also detect the rate of movement of the controls. The hull sensors 411, 414 detect the acceleration, speed, and direction the hull is traveling through the water. For fixed pitch propellers, the propeller sensor 430 detects the propeller 30 RPM and direction of rotation. For controllable pitch propellers, the propeller sensors 411, 414 detect propeller 30 RPM and pitch setting (including thrust direction). The forward and aft rudder sensors 58, 68 detect the respective rudder angles $\alpha$ and $\beta$ (illustrated in FIG. 2).

Based on the input information, the algorithm 70 calculates rudder angles for one or both rudders 50, 60. For each rudder 50, 60 it is controlling, the algorithm 70 calculates a desired rudder angle $\alpha$, $\beta$ and a corresponding rudder angle command to achieve as much. The algorithm 70 calculates the desired rudder angle $\alpha$, $\beta$ based on the sensed conditions. However, because of the inherent limits of the steering system, the desired rudder angle $\alpha$, $\beta$ may not be achievable, either instantaneously or at all. A rudder angle rate limiting function may also be implemented in the electronic controller 113, in an individual rudder controller 56, 66, by some other means, or may not be necessary based on the type of the watercraft's pre-existing rudder controls. When the control system relies on the algorithm to limit the rate of change of the rudder angle $\alpha$, $\beta$, the algorithm computes intermediate commanded angles to achieve a desired angle.

The electronic controller 113 preferably includes a comparator function with which the algorithm 70 compares the desired rudder angle $\alpha$, $\beta$ with the current rudder angle as detected by sensors 58, 68. The algorithm 70 produces a series of intermediate commanded rudder angles that achieve the desired rudder angle α, β without exceeding the control system's maximum permissible rate of change of rudder angle. Further, the algorithm 70 is adapted to limit the commanded angle to the watercraft steering system's mechanical limits, preferably to angles α and β of less than 35° from the centerline 10*a* of boat 10. The algorithm 70 also preferably contains a smoothing function to avoid rapid changes in rudder angle commands. The smoothing function compensates for noise in sensors or controls and for rapid fluctuations in sensed conditions.

The rudder angle control algorithm 70 is based on mathematical models for rudders 50 and 60 and the steering forces, they are expected to produce in various conditions. Formulas to approximate forces on rudders (hydrofoils) at angles of attack less than the stall angle are known in the art. For example, the forces on a rudder are proportional to the square of the inflow velocity. However, numerous complexities affecting rudder forces also exist such as operating at a rudder angle greater than the stall angle of attack, hull interaction with flow around the rudder (hull wake), rudder physical profile (e.g., hydrofoil shape, chord length, rudder thickness), turbulence of inflow to the rudder, and other factors. These complexities are preferably approximated in the algorithm 70 using constants. The constants of algorithm 70 may be tuned for different types of watercraft through experimentation and testing.

Some embodiments limit the rudder angle based on the stall angle. When a rudder stalls, the steering force is greatly decreased, and rudder effectiveness plummets. The stall angle is principally affected by the aspect ratio (thickness to chord ratio), the rudder profile shape, the Reynolds number (which is itself affected by chord, inflow speed, and angle of attack), turbulence of inflow including turbulence inducing factors on the hull and on the rudder itself (such as leading edge irregularities or surface roughness). For this invention, the forward rudder's stall angle is most affected by factors causing the separation of the laminar flow. Ventilation and cavitation can also decrease rudder effectiveness but are not particularly problematic here due to typical hull design and the restriction to forward rudder deployment only at slow hull speeds.

The rudder angle control algorithm 70, of electronic controller 113, has at least three alternative control strategy variations for computing the desired rudder angle: a proportional angle control strategy, an optimal angle control strategy, and a simpler on/off control strategy variation.

Figure 7:
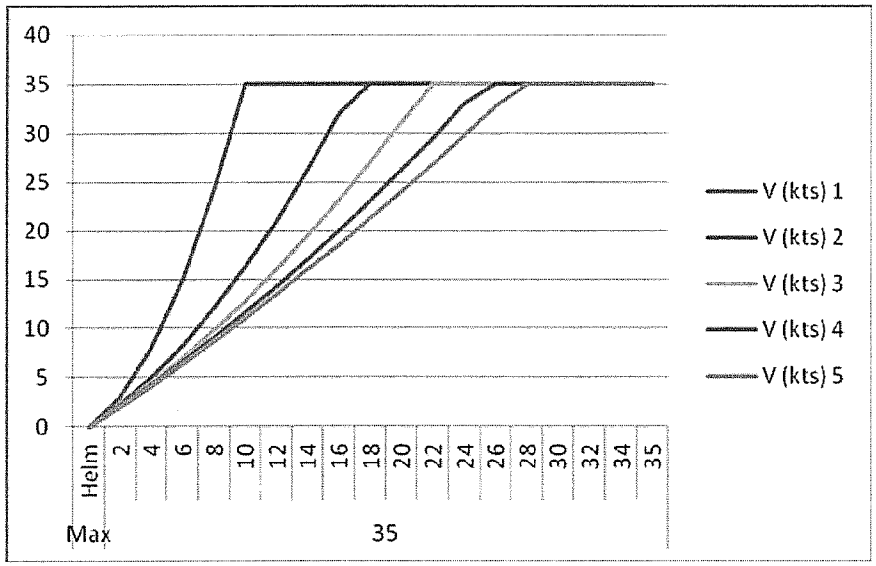
FIG. 7 depicts a chart and a corresponding graph exemplifying an example of a control strategy based on the optimal forward rudder angle, α, in relation to actual hull speed, 'V', as well as the desired helm angle, 'ϕ'.

FIG. 6 and FIG. 7 illustrate various operating characteristics of some preferred embodiments of the various control strategies for the control algorithm 70. For illustrating such operating characteristics, FIG. 6 and FIG. 7 depict several preferred forward rudder angles, α, based on the watercrafts velocity, 'V', in relation to the helm angle, 'ϕ'. For purposes of determining the preferred forward rudder angles, α, in FIGS. 6 and 7, other variable such as wake generating speed 'W', aft rudder angle, 'β', and a constant 'K', etc., play an important role in determining α.

The "on/off" variation of algorithm 70 controls the angle β of aft rudder 60 generally the same as with prior, conventional approaches, but also supplements as much with occasional actuation of fore rudder 50 depending on the speed "V" and forward/reverse direction in which watercraft 10 is moving (preferably as determined by sensor input). The simplest "on/off" variation always actuates fore rudder 50 to its maximum positions—where α is preferably plus or minus 35° from the centerline 10 of boat 10. For instance, with one such preferred variation of algorithm 70, the operating rules as depicted in FIG. 6 are achieved. Hence, in a slow forward motion (e.g., V<W) or any reverse motion (V<O), α, is moved in the corresponding direction.

As an example of such an "on/off" variation, rows 1 and 4 of FIG. 6 respectively portray 'ϕ' and "±max" as the angle α for the forward rudder 50 corresponding to a particular velocity V and helm angle ϕ conditions. Referring to FIG. 6 row 1, when the watercrafts hull speed is 'fast' in the forward direction expressed in FIG. 6 as V≥W (the watercraft's hull speed is greater than or equal to the wake speed, W) then the front rudder 50, is centerline with the boat, yielding a 0° α, in all helm directions, ϕ. Note that as a frame of reference, 0° α is based on the premise that 0° is centerline with the boat, and deviation plus or minus from 0° corresponds to the front rudder turn angle. Similarly, referring to FIG. 6 row 4, when the watercraft's hull speed, V is in a slow reverse direction, between 0 knots but greater than the wake speed W, expressed as −W<V<0, then the front rudder 50, is at its maximum angle, α, in the opposite direction of the helm directions, ϕ.

Proportional angle calculation is more complicated than the "on/off" control strategy variation but is still based on a simpler model than the "optional". The proportional approach is best illustrated in FIG. 6. The angle is determined using fewer inputs and without dynamically computing stall angle. The optimal angle calculation is based on a more comprehensive model with more inputs, more comparisons and calculations, and considers the stall angle.

It should be understood that the speed of differentiating control may be adjusted in alternative embodiments. For instance, rather than change the result based on whether boat speed (V) is above or below wake speed, some other speed may be chosen, such as half of wake speed or twice wake speed. As one example of an analogous representation reference FIG. 6 row 5. Note that "wake" speed is assumed to be approximately 5 m.p.h., but this would depend on the boat 10 (and its weight distributions and/or trim settings or the like), the weather, the water 100, and the direction of travel. Also recognize that various different constants may be used in proportional controls, and that alternative embodiments may deploy an algorithm that hybridizes an "on/off" approach with a "proportional" and/or an "optimal" approach.

Irrespective of the other preferred details in algorithm 70, the algorithm 70 monitors a variety of sensed conditions to determine when the forward rudder 50 is needed to augment steering forces. For example, the aft rudder 60 alone provides sufficient steering forces when the watercraft 10 is operating at medium to high forward hull speeds. As expressed in FIG. 6 row 1, at such forward speeds, the algorithm 70, calculates a desired zero forward rudder angle and commands the forward rudder to align with the longitudinal centerline of the propeller shaft. At slow forward speeds, some embodiments deploy the forward rudder to augment steering forces (for example see FIG. 6 row 2 and row 3); other embodiments deploy the forward rudder only when the throttle is set to astern (see for example FIG. 6 for 4). When moving astern, the watercraft's hull design limits it to slow speeds astern. Therefore, the rudder angle control algorithm typically calculates non-zero forward rudder angles only when the watercraft is within slow hull speed limits.

The algorithm also includes internal limitations for other operating and safety considerations. For example, regardless of sensed conditions, the algorithm never commands a rudder angle in excess of the mechanical or safety limits of the rudder. In case of certain sensor failures, the electronic controller informs the operator a failure has occurred and commands the forward rudder to a zero angle. In case of electronic controller failure, fail-safe means command the forward rudder to a zero angle and allow the watercraft's manual steering system to resume unaided control of the aft rudder.

Preferred Embodiments of Forward Rudder Proportional Control

A preferred embodiment of the invention is a steering control system for a watercraft with an inboard motor driving a single, non-steerable propeller. This embodiment can be retrofitted onto an existing watercraft by adding a forward rudder and the control system, leaving the previous shaft, strut, and aft rudder in place. FIG. 1 is a simplified elevation view of this embodiment of the invention.

This preferred embodiment of the invention uses an electronic controller to control only the forward rudder; the watercraft's pre-existing steering system controls the aft rudder. The electronic controller receives sensor information from the helm and throttle controls, and the rudder angle control algorithm uses the proportional angle calculation to determine only the forward rudder angle.

When the throttle is set to ahead (forward thrust commanded—propeller wash flowing aft), or when the throttle is set to stop (zero propulsive thrust commanded), the algorithm generates a desired rudder angle of zero degrees for the forward rudder and sends appropriate signals to the forward rudder controller. This example is portrayed in FIG. 6 row 1. Another example when the throttle is set to astern ($V<0$), the algorithm calculates a desired forward rudder angle which is proportional to the aft rudder angle ($K*\beta$) and sends appropriate commanded rudder angle signals to the forward rudder controller, regardless of the helm direction, $\phi$.

Figure 5:
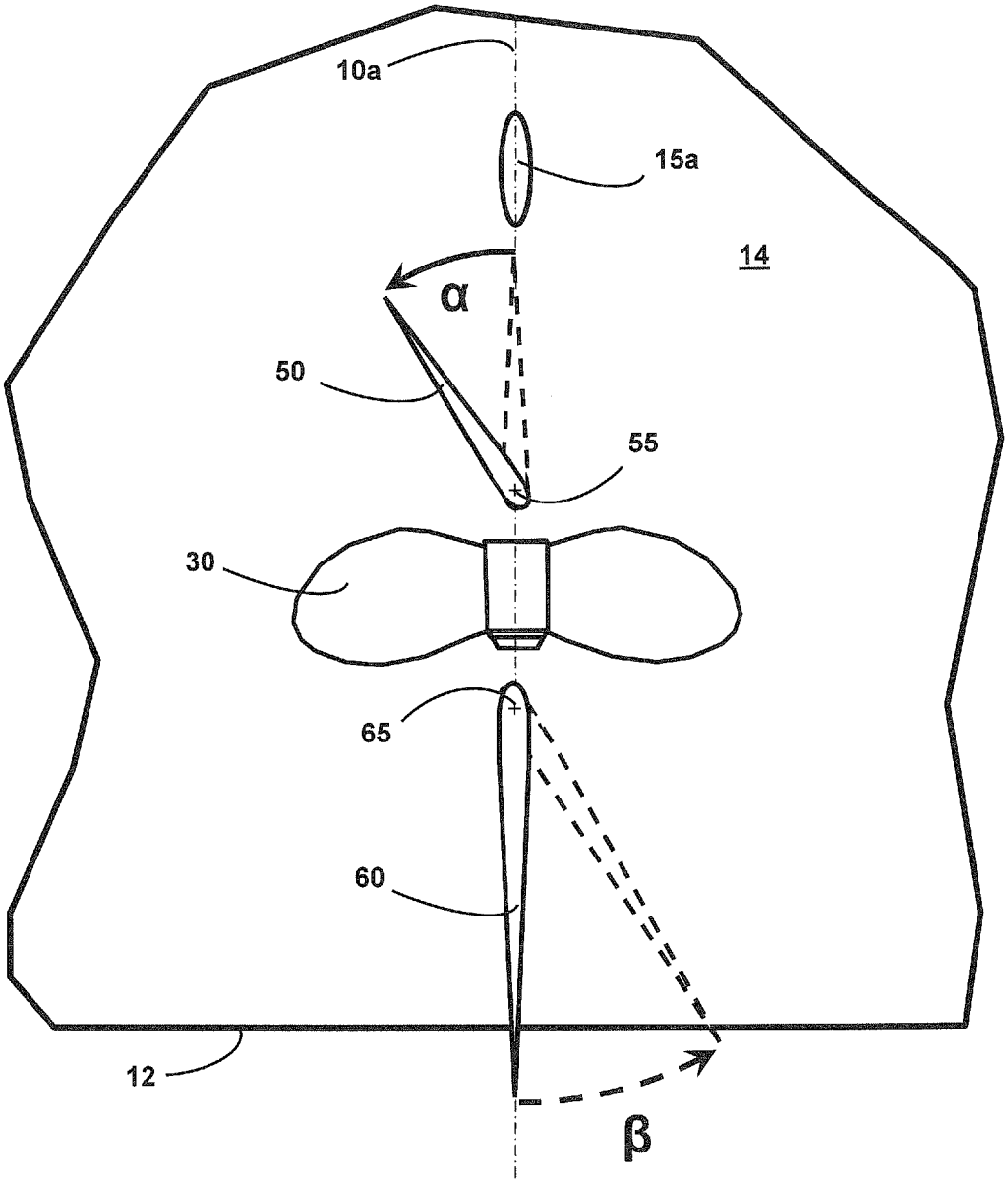
FIG. 5 is a partial quasi-cross-sectional view from the underside of the watercraft 10, with most components shown full-round rather than in true cross section, the view approximating a view along sectional plane 5-5 of FIG. 2, to facilitate description of the relative operative positions of fore rudder 50 and aft rudder 60 in relation to the centerline 10*a* of hull 14.

In the preferred embodiment, when the operator wants to back the watercraft to port, the operator sets the throttle to astern and sets the helm to port. The watercraft's steering system swings the aft rudder to port. With the throttle set to astern, the propeller wash flows stern to bow across the forward rudder. The electronic controller senses that the throttle is set to astern and swings the forward rudder in proportion to the aft rudder angle; however, the forward rudder swings to starboard. As the propeller wash impinges on the forward rudder, it redirects the propeller wash to starboard, which moves the watercraft's stern to port as shown in FIG. 5.

Conversely, when the operator wants to back the watercraft to starboard, the operator sets the throttle to astern and sets the helm to starboard. The watercraft's steering system swings the aft rudder to starboard. The electronic controller senses that the throttle is set to astern and swings the forward rudder to port in proportion to the aft rudder angle. As the propeller wash impinges on the forward rudder, it redirects the propeller wash to port, which moves the watercraft's stern to starboard.

In an embodiment where the control system only controls the forward rudder, the algorithm commands the forward rudder in proportion to the aft rudder angle; the watercraft's pre-existing steering system controls the aft rudder. Referring to FIG. 6 row 2 and 3, the forward rudder angle, $\alpha$, at forward hull speeds less than five knots, the algorithm deploys the forward rudder to assist in steering. When the helm is set to a small steering angle (small helm angle is relative to various conditions such as helm speed, helm direction, etc.), for example an aft rudder angle of starboard five degrees, the algorithm calculates a proportional port rudder angle for the forward rudder. Expressed another way, if $0<V<W$ (the helm speed slow in the forward direction), and the desired helm direction is small ($-5° \leq \phi \leq 5°$), then the fore rudder 50 angle, $\alpha$ is expressed by '$-K\beta$'

However, if at forward hull speeds less than five knots, and the operator commands a larger aft rudder angle, the algorithm calculates a forward rudder angle proportional to, but greater than, the commanded aft rudder angle without regard to the stall angle for the forward rudder. For example, FIG. 6 row 2 and 3 portray such an example.

In another variation of the preferred embodiment, when backing at slow speeds, corresponding actions occur. When the helm is set to a small steering angle, for example an aft rudder angle of port five degrees, the algorithm calculates a proportional starboard rudder angle for the forward rudder. If the operator commands a larger aft rudder angle, the algorithm calculates a forward rudder angle proportional to, but greater than, the commanded aft rudder angle without regard to the stall angle for the forward rudder.

Preferred Embodiments of Forward Rudder Optimal Control

Another preferred embodiment of the invention uses an electronic controller and an optimal rudder angle algorithm to control the forward rudder. The electronic controller receives sensed conditions including hull speed, hull direction, aft rudder angle, throttle setting, throttle movement, helm setting, and helm movement. This approach is best illustrated in FIG. 7. Based on these inputs, the electronic controller determines the optimal angle for the forward rudder and sends appropriate control signals to the forward rudder controller. For example, FIG. 7 portrays the optimal forward rudder angle based on helms commanded angle of the rear rudder, and the hull speed. The optimal angle calculation includes more sensed conditions than does the proportional angle calculation.

When the throttle is set to ahead or to stop, similarly to the previous control strategies, the electronic controller keeps the forward rudder aligned with the longitudinal centerline of the watercraft irrespective of the helm command. Referring to FIG. 6 row 1, when the watercrafts hull speed is 'fast' speed in the forward direction expressed in FIG. 6 as $V \geq W$ (the watercrafts hull speed is greater than or equal to the wake speed, W) then the front rudder 50, is centerline with the boat yielding a 0° $\alpha$ (0° $\alpha$ is based on the premise that 0° is centerline with the boat, and deviation plus or minus from 0° corresponds to the front rudder turn angle), in all helm directions, $\phi$.

When the throttle is set to astern, the electronic controller determines the optimal angle for the forward rudder. FIG. 7 portrays an example of the optimal fore rudder angle, $\alpha$, depending on speed, V, helm command direction, $\phi$. For example, if the hull speed is 1 knot, and the helm angle is between 2° and 8°, then the fore rudder angle, $\alpha$, is some function of $\beta$. However, if the helm angle is greater than 10° then the fore rudder angle, $\alpha$, is at its maximum, 35°. Similarly, if the hull speed is 5 knots, and the helm angle is between 2° and 26°, then the fore rudder angle, $\alpha$, is some function of $\beta$. However, if the helm angle is greater than 26° then the fore rudder angle, $\alpha$, is at its maximum, 35°. Thereby, FIG. 7 portrays an example of how to optimal control strategy determines the ideal angle of the fore rudder.

The optimal angle for the forward rudder depends on the sensed conditions. For backing to port, the operator sets the throttle to astern, selects the helm to port, and the watercraft's steering system swings the aft rudder to port. The electronic controller detects the throttle set to astern, considers the other sensed conditions, calculates the optimal forward rudder angle for maximum steering effectiveness, and sends appropriate commands to the forward rudder controller to achieve the optimal starboard rudder angle. The forward rudder effectively redirects the propeller wash to starboard, which moves the watercraft's stern to port.

For backing to starboard, the operator sets the throttle to astern, selects the helm to starboard, and the watercraft's steering system swings the aft rudder to starboard. The electronic controller detects the throttle set to astern, analyzes the other sensed conditions, calculates the optimal forward rudder angle for maximum steering effectiveness, and sends the appropriate optimal port rudder angle command to the forward rudder controller. The forward rudder effectively redirects the propeller wash to port, which moves the watercraft's stern to starboard.

Alternate Embodiments Controlling Forward and Aft Rudders

In an alternate embodiment of the invention, both the forward and aft rudders are controlled in a "steer-by-wire" fashion by the electronic control system. An aft rudder controller controls the motion of the aft rudder. The control system uses the inputs from the various sensors as well as the operator inputs to determine the optimal angle for the forward and aft rudders and sends the corresponding control signals to the forward rudder controller and aft rudder controller.

Alternate Embodiments with Forward Rudder Design Modifications

In the preferred embodiment, the invention, including a forward rudder, is retrofitted onto an existing watercraft. In some installations, the surface area of the forward rudder is substantially limited by the dimensions of the watercraft and the boat manufacturer's relative location of the strut 15, shaft, 25 and propeller 30. If a larger surface area than that of the preferred embodiment is desired, an alternate embodiment of the invention consists of a three-piece forward rudder where one piece pivots both left and right of strut 15, just like main body 50*a* in FIG. 2. However, the three-piece rudder construction also has a second rudder portion that is engaged to pivot left of strut 15 when the main body 50*a* so moves, and a third and opposite portion is engaged to pivot right of strut 15 when the main body 50*a* so moves. The three-piece forward rudder is designed to maintain or improve the hydrodynamics of the watercraft. The upper portion 15*a*, located above the propeller shaft, acts as a rearward extension of the strut 15. Alternatively, in some circumstances, it may be beneficial to replace strut 15 with a strut that contains an integrated forward rudder 50, with structural accommodations such that forward rudder 50 is pivotally connected directly to strut 15.

Alternate Embodiments with Twin Flaps Replacing Forward Rudder

In another alternate embodiment, the forward rudder function is accomplished using twin flaps. The flaps are offset laterally and symmetrically from the shaft, one flap to starboard and the other flap to port. To deploy, the flaps rotate about axes that run parallel to the underside of the hull of the watercraft and displace into the fluid flow. When stowed, the flaps generally conform to the underside of the hull. The rotational axes of the flaps are located forward of the trailing edge of the flaps, which trailing edges are towards the stern of the watercraft. The axes of the flaps are located forward of the propeller. Each flap is equipped with a flap sensor and is in communication with a flap controller that sends signals from the control system. Based on the sensed conditions, the electronic controller determines which flap to lower and sends the appropriate control signal to the flap controller.

Numerous Other Embodiments

Also recognize that, to concisely teach inventive principles, some conventional aspects of the invention have been simplified or omitted. As noted above, certain features of the invention described herein as pertaining to separate embodiments can also be implemented in combination in a single embodiment. Conversely, various features that are described in the context of an illustrative single embodiment can also be implemented in multiple embodiments separately or in any suitable sub-combination. Moreover, although features may be described or claimed as acting in certain combinations, one or more features of a combination may be omitted from the combination, and the claimed combination may be directed to a sub-combination or variation of a sub-combination.

In all respects, it should also be understood that the drawings and detailed description herein are to be regarded in an illustrative rather than a restrictive manner, and are not intended to limit the invention to the particular forms and examples disclosed. Rather, the invention includes all embodiments and methods within the scope and spirit of the invention as claimed, as the claims may be amended, replaced or otherwise modified during the course of related prosecution. Any current, amended, or added claims should be interpreted to embrace all further modifications, changes, rearrangements, substitutions, alternatives, design choices, and embodiments that may be evident to those of skill in the art, whether now known or later discovered. In any case, all substantially equivalent systems, articles, and methods should be considered within the scope of the invention and, absent express indication otherwise, all structural or functional equivalents are anticipated to remain within the spirit and scope of the present inventive system and method. Many other alternatives, variations, equivalents, substitutions, combinations, simplifications, elaborations, distributions, enhancements, improvements or eliminations will be evident to those skilled in the art while still being embraced by the invention as defined in the claims, as may be subsequently added or amended.

We claim:

1. A steering system for a ski boat having a helm, a propulsion motor, a propeller, and a rotatable propeller shaft, said helm being adapted for input of operator commands for speed and steering, said propeller being mounted on said rotatable propeller shaft, said propeller shaft being linked to transfer power directly or indirectly from said propulsion motor to said propeller, and said propeller being positioned to be in a flow of water supporting said ski boat when said ski boat is moving relative to the water, comprising:

a. a pair of rudders operatively mounted to interact with said flow of water;

b. said pair of rudders including a movable aft rudder operatively mounted to interact with said flow of water aftward of said propeller;

c. a movable forward rudder operatively mounted to interact with said flow of water forward of said propeller; and d. a rudder control system including controls that operatively move one of said pair of rudders without moving the other of said pair of rudders when the ski boat is traveling in a first range of speed conditions;

e. said rudder control system also including controls that operatively move both of said pair of rudders, thereby achieving greater exposure of rudder turning surfaces to said water flow when the ski boat is traveling in a second range of speed conditions;

f. an aft rudder steering shaft attached to said aft rudder, the rotational axis of said aft rudder steering shaft positioned aft of said non-steerable propeller and approximately intersecting along the extended centerline of said propeller shaft;

g. an aft rudder controller in communication with, and capable of controlling, the pivotal movement of said aft rudder steering shaft and thereby changing the angle of said aft rudder in relation to the longitudinal centerline of said propeller shaft;

h. a throttle control to command the speed and thrust direction of said non-steerable propeller;

i. a strut securing said propeller shaft to said hull of said ski boat;

j. said movable forward rudder located generally aft of said strut and forward of said non-steerable propeller;

k. a forward rudder steering shaft attached to said forward rudder, the rotational axis of said forward rudder steering shaft positioned forward of said non-steerable propeller and along the longitudinal centerline of said propeller shaft;

l. a forward rudder controller capable of controlling the movement of said forward rudder steering shaft and thereby changing the angle of said forward rudder in relation to the longitudinal centerline of said propeller shaft;

m. one or more sensors being configured for detecting various operational conditions of said steering system;

n. an electronic controller receiving input information from said one or more sensors;

o. said electronic controller sending control signals to said forward rudder controller based on said input information, said control signals transmitted to said forward rudder controller to rotate said forward rudder steering shaft and thereby change the angle of said forward rudder in relation to the longitudinal centerline of said propeller shaft, such that:

(1) when said throttle control commands a reverse thrust and said helm is selected to starboard, said forward rudder rotates to port in direct proportion to the aft rudder rotation to starboard; and (2) when said throttle control commands a reverse movement and said helm is selected to port, said forward rudder rotates to starboard in direct proportion to the aft rudder rotation to port.

2. The steering system of claim 1, wherein said second range of speed conditions includes conditions that are characteristic of some or all no-wake speeds for said ski boat.

3. The steering system of claim 1, wherein said second range of speed conditions includes conditions that are characteristic of reverse speeds for said ski boat.

4. The steering system of claim 1, wherein said first range of speed conditions includes conditions that are characteristic of reverse speeds for said ski boat.

5. The steering system of claim 1, wherein said controls are adapted to operatively move the aft rudder without moving the forward rudder when the ski boat is traveling in said first range of speed conditions, and wherein said first range of speed conditions includes conditions that are characteristic of ski boat speeds that are in excess of no-wake speeds for said ski boat.

6. The steering system of claim 1, wherein said controls are adapted to operatively move the forward rudder without moving the aft rudder when the ski boat is traveling in said first range of speed conditions, and wherein said first range of speed conditions includes conditions that are characteristic of reverse ski boat speeds.

7. The steering system of claim 1, wherein said rudder control system includes controls that operatively move the aft rudder without moving the forward rudder when the ski boat is traveling in said second range of speed conditions, said second range of speed conditions including conditions that are characteristic of ski boat speeds that are in excess of no-wake speeds for said ski boat.

8. The steering system of claim 1, wherein said one or more sensors comprises an aft rudder angle sensor for detecting and transmitting a relative rotational position of said aft rudder steering shaft.

9. The steering system of claim 1, wherein said one or more sensors comprises a helm sensor for transmitting said helm's command to said aft rudder controller.

10. The steering system of claim 1, wherein said one or more sensors comprises a throttle control sensor for detecting and transmitting said throttle control's speed and thrust direction commands.

11. The steering system of claim 1, wherein said aft rudder rotates to port when said helm is commanded to port, and said aft rudder rotates to starboard when said helm is commanded to starboard.

12. A system for steering a ski boat having a hull as well as a bow and a stern, comprising:

a. a ski boat with a single propulsion motor where said motor is located between the bow and stern of the hull;

b. said ski boat having a single, non-steerable propeller;

c. a helm;

d. a propeller shaft transferring power from said propulsion motor to said non-steerable propeller;

e. an aft rudder located aft of said non-steerable propeller;

f. an aft rudder steering shaft attached to said aft rudder, the rotational axis of said aft rudder steering shaft positioned aft of said non-steerable propeller and along the extended centerline of said propeller shaft;

g. an aft rudder controller in communication with, and capable of controlling the movement of, said aft rudder steering shaft and thereby changing the angle of said aft rudder in relation to the longitudinal centerline of said propeller shaft;

h. an aft rudder angle sensor for detecting and transmitting a rotation of said aft rudder steering shaft;

i. a helm sensor transmitting said helm's command to said aft rudder controller;

j. a throttle control to command the speed and thrust direction of said non-steerable propeller;

k. a throttle control sensor detecting and transmitting said throttle control's speed and thrust direction commands;

l. a strut securing said propeller shaft to said hull of said ski boat;

m. a forward rudder located generally aft of said strut and forward of said non-steerable propeller;

n. a forward rudder steering shaft attached to said forward rudder, the rotational axis of said forward rudder steering shaft positioned forward of said non-steerable propeller and along the longitudinal centerline of said propeller shaft;

o. a forward rudder controller capable of controlling the movement of said forward rudder steering shaft and thereby changing the angle of said forward rudder in relation to the longitudinal centerline of said propeller shaft;

p. an electronic controller receiving input information from said helm sensor, said throttle control sensor, and said aft rudder angle sensor, said electronic controller including a control signal generator;

q. said control signal generator sending control signals to said forward rudder controller based on said in put information, said control signals transmitted to said forward rudder controller to rotate said forward rudder in relation to the longitudinal centerline of said propeller shaft; such that:

(1) when said throttle control commands a reverse thrust and said helm is selected to starboard, said forward rudder rotates to port in direct proportion to the aft rudder rotation to starboard;

(2) when said throttle control commands a reverse thrust and said helm is selected to port, said forward rudder rotates to starboard in direct proportion to the aft rudder rotation to port.

13. The system of claim 12, further comprising:

a. said forward rudder consisting of two connected sections: an upper section located between the hull of said ski boat and the top of the propeller shaft and a lower section extending below said propeller shaft;

b. said lower section designed to minimize drag when said ski boat is traveling forward at high speeds.

14. A ski boat steering system for steering a ski boat having a hull as well as a bow and a stern, comprising:

a. a ski boat with a single propulsion motor where said motor is located between the bow and stern of the hull;

b. said ski boat having a single, non-steerable propeller;

c. a helm;

d. a propeller shaft transferring power from said propulsion motor to said non-steerable propeller;

e. an aft rudder located aft of said non-steerable propeller;

f. an aft rudder steering shaft attached to said aft rudder, the rotational axis of said aft rudder steering shaft positioned aft of said non-steerable propeller and along the extended centerline of said propeller shaft;

g. an aft rudder controller in communication with, and capable of controlling the movement of, said aft rudder steering shaft and thereby changing the angle of said aft rudder in relation to the longitudinal centerline of said propeller shaft;

h. an aft rudder angle sensor for detecting and transmitting a rotation of said aft rudder steering shaft;

i. a helm sensor transmitting said helm's command to said aft rudder controller;

j. a throttle control to command the speed and thrust direction of said non-steerable propeller;

k. a throttle control sensor detecting and transmitting said throttle control's speed and thrust direction commands;

l. a strut securing said propeller shaft to said hull of said ski boat;

m. a forward rudder located generally within said strut and forward of said non-steerable propeller wherein said forward rudder has a larger surface area than one constrained to use said ski boat's previous strut;

n. a forward rudder steering shaft attached to said forward rudder for controlling the position of said forward rudder, the rotational axis of said forward rudder steering shaft positioned forward of said non-steerable propeller and along the longitudinal centerline of said propeller shaft;

o. a forward rudder controller capable of controlling the movement of said forward rudder steering shaft and thereby changing the angle of said forward rudder in relation to the longitudinal centerline of said propeller shaft;

p. an electronic controller receiving input information from said helm sensor, said throttle control sensor, and said aft rudder angle sensor, said electronic controller including a control signal generator;

q. said control signal generator sending control signals to said forward rudder controller based on said input information, said control signals transmitted to said forward rudder controller to rotate said forward rudder steering shaft and thereby change the angle of said forward rudder in relation to the longitudinal centerline of said propeller shaft, such that:

(1) when said throttle control commands a reverse thrust and said helm is selected to starboard, said forward rudder rotates to port in direct proportion to the aft rudder rotation to starboard;

(2) when said throttle control commands a reverse thrust and said helm is selected to port, said forward rudder rotates to starboard in direct proportion to the aft rudder rotation to port.

15. A system for steering a ski boat having a hull as well as a bow and a stern, comprising:

a. a ski boat with a single propulsion motor where said motor is located between the bow and stern of the hull;

b. said ski boat having a single, non-steerable propeller;

c. a helm;

d. a propeller shaft transferring power from said propulsion motor to said non-steerable propeller;

e. an aft rudder located aft of said non-steerable propeller;

f. an aft rudder steering shaft attached to said aft rudder, the rotational axis of said aft rudder steering shaft positioned aft of said non-steerable propeller and along the extended centerline of said propeller shaft;

g. an aft rudder controller in communication with, and capable of controlling the movement of, said aft rudder steering shaft and thereby changing the angle of said aft rudder in relation to the longitudinal centerline of said propeller shaft such that when said helm is commanded to starboard, said aft rudder rotates to starboard and when said helm is commanded to port, said aft rudder rotates to port;

h. an aft rudder angle sensor for detecting and transmitting a rotation of said aft rudder steering shaft;

i. a helm sensor transmitting said helm's command to said aft rudder controller;

j. a throttle control to command the speed and thrust direction of said non-steerable propeller;

k. a throttle control sensor detecting and transmitting said throttle control's speed and thrust direction commands;

l. a strut securing said propeller shaft to said hull of said ski boat;

m. a forward rudder located generally aft of said strut and forward of said non-steerable propeller;

n. a forward rudder steering shaft attached to said forward rudder, the rotational axis of said forward rudder steering shaft positioned forward of said non-steerable propeller and along the longitudinal centerline of said propeller shaft;

o. a forward rudder controller capable of controlling the movement of said forward rudder steering shaft and thereby changing the angle of said forward rudder in relation to the longitudinal centerline of said propeller shaft;

p. a forward rudder angle sensor for detecting and transmitting a rotation of said forward rudder steering shaft;

q. a ski boat speed sensor for detecting and transmitting the speed of said ski boat;

r. a ski boat direction sensor capable of measuring and transmitting the direction of movement of said ski boat;

s. a propeller sensor capable of measuring and transmitting the speed of rotation of said propeller and the thrust direction of said propeller;

t. an electronic controller receiving input information from said helm sensor, said throttle control sensor, said ski boat speed sensor, said ski boat direction sensor, said propeller sensor, said aft rudder angle sensor, and said forward rudder angle sensor, said electronic controller including a control signal generator;

u. said control signal generator calculating optimal rudder angle commands based on said input information and sending control signals to achieve said optimal rudder angle to said forward rudder controller to rotate said forward rudder steering shaft and thereby change the angle of said forward rudder in relation to the longitudinal centerline of said propeller shaft, such that:

(1) when said throttle control commands a reverse thrust and said helm is selected to starboard, said forward rudder rotates optimally to port;

(2) when said throttle control commands a reverse thrust and said helm is selected to port, said forward rudder rotates optimally to starboard.

16. The system of claim 15, further comprising:

a. said forward rudder consisting of two connected sections; an upper section located between the hull of said ski boat and the top of the propeller shaft and a lower section extending below said propeller shaft;

b. said lower section designed to minimize drag when said ski boat is traveling forward at high speeds.

17. A system for steering a ski boat having a hull as well as a bow and a stern, comprising:

a. a ski boat with a single propulsion motor where said motor is located between the bow and stern of the hull;

b. said ski boat having a single, non-steerable propeller;

c. a helm;

d. a propeller shaft transferring power from said propulsion motor to said non-steerable propeller;

e. an aft rudder located aft of said non-steerable propeller;

f. an aft rudder steering shaft attached to said aft rudder, the rotational axis of said aft rudder steering shaft positioned aft of said non-steerable propeller and along the extended centerline of said propeller shaft;

g. an aft rudder controller in communication with, and capable of controlling the movement of, said aft rudder steering shaft and thereby changing the angle of said aft rudder in relation to the longitudinal centerline of said propeller shaft such that when said helm is commanded to starboard, said aft rudder rotates to starboard and when said helm is commanded to port, said aft rudder rotates to port;

h. an aft rudder angle sensor for detecting and transmitting a rotation of said aft rudder steering shaft;

i. a helm sensor transmitting said helm's command to said aft rudder controller;

j. a throttle control to command the speed and thrust direction of said non-steerable propeller;

k. a throttle control sensor detecting and transmitting said throttle control's speed and thrust direction commands;

l. a replacement strut securing said propeller shaft to said hull of said ski boat;

m. a forward rudder located generally within said replacement strut and forward of said non-steerable propeller wherein said forward rudder has a larger surface area than on constrained to use said ski boat's previous strut;

n. a forward rudder steering shaft attached to said forward rudder, the rotational axis of said forward rudder steering shaft positioned forward of said non-steerable propeller and along the longitudinal centerline of said propeller shaft;

o. a forward rudder controller capable of controlling the movement of said forward rudder steering shaft and thereby changing the angle of said forward rudder in relation to the longitudinal centerline of said propeller shaft;

p. a forward rudder angle sensor for detecting and transmitting a rotation of said forward rudder steering shaft;

q. a ski boat speed sensor for detecting and transmitting the speed of said ski boat;

r. a ski boat direction sensor capable of measuring and transmitting the direction of movement of said ski boat;

s. a propeller sensor capable of measuring and transmitting the speed of rotation of said propeller and the thrust direction of said propeller;

t. an electronic controller receiving input information from said helm sensor, said throttle control sensor, said ski boat speed sensor, said ski boat direction sensor, said propeller sensor, said aft rudder angle sensor, and said forward rudder angle sensor, said electronic controller including a control signal generator;

u. said control signal generator calculating optimal rudder angle commands based on said input information and sending control signals to achieve said optimal rudder angle to said forward rudder controller to rotate said forward rudder steering shaft and thereby change the angle of said forward rudder in relation to the longitudinal centerline of said propeller shaft, such that;

(1) when said throttle control commands a reverse thrust and said helm is selected to starboard, said forward rudder rotates optimally to port;

(2) when said throttle control commands a reverse thrust and said helm is selected to port, said forward rudder rotates optimally to starboard.

* * * * *